US006976719B2

(12) United States Patent
Agayof et al.

(10) Patent No.: US 6,976,719 B2
(45) Date of Patent: Dec. 20, 2005

(54) ADJUSTABLE PLASTIC CARRY STRAP HAVING LATERALLY PROJECTING FOLDABLE HANDLES

(75) Inventors: Jacobv Agayof, Kibbutz Mishmar Ha'Emek (IL); Gil Tzur, Kibbutz Mishmar Ha'Emek (IL)

(73) Assignee: Tama Plastic Industry, Kibbutz Mishmar Ha'Emek (IL)

( * ) Notice: Subject to any disclaimer, the term of this patent is extended or adjusted under 35 U.S.C. 154(b) by 0 days.

(21) Appl. No.: 10/509,159

(22) PCT Filed: Oct. 24, 2003

(86) PCT No.: PCT/IB03/04713

§ 371 (c)(1),
(2), (4) Date: Sep. 28, 2004

(87) PCT Pub. No.: WO2004/103848

PCT Pub. Date: Dec. 2, 2004

(65) Prior Publication Data

US 2005/0146149 A1 Jul. 7, 2005

(51) Int. Cl.[7] ..... A45F 5/00
(52) U.S. Cl. ..... 294/150; 294/156; 294/165; 24/16 PB
(58) Field of Search ..... 294/31.2, 149, 294/150, 153, 156, 165, 137; 24/16 PB, 30.5 P, 24/30.5 L, 30.5 S

(56) References Cited

U.S. PATENT DOCUMENTS

| | | | |
|---|---|---|---|
| 487,145 | A | 11/1892 | Gibbons |
| 627,920 | A | 6/1899 | Gould |
| 876,402 | A | 1/1908 | Schacht |
| 1,146,334 | A | 7/1915 | Lehman et al. |
| 1,232,252 | A | 7/1917 | Eames |
| 1,539,201 | A | 5/1925 | Ottow |
| 1,810,027 | A | 6/1931 | Moran et al. |
| 1,824,027 | A | 10/1931 | Lundquist |
| 1,829,613 | A | 10/1931 | Sato |
| 1,945,932 | A | 2/1934 | Caley |
| 2,128,723 | A | 8/1938 | Zettler |
| 2,314,799 | A | 3/1943 | Fuhrmann |
| 2,361,506 | A | 10/1944 | Smith |
| 2,468,355 | A | 4/1949 | Ambler |
| 2,559,556 | A | 7/1951 | Ambler |
| 2,617,143 | A | 11/1952 | Blake |
| 2,723,067 | A | 10/1955 | Fretz |
| 2,936,980 | A | 5/1960 | Rapata |
| 2,961,785 | A | 11/1960 | Toepfer |
| 3,048,906 | A | 8/1962 | Patterson |

(Continued)

FOREIGN PATENT DOCUMENTS

| | | |
|---|---|---|
| DE | 7613358 | 9/1976 |

(Continued)

*Primary Examiner*—Dean J. Kramer
(74) *Attorney, Agent, or Firm*—Morgan & Finnegan, LLP

(57) ABSTRACT

An adjustable carry strap and handle for facilitating the lifting of an object, such as a roll of material. The carry strap and handle has an elongated and substantially planar strap. Coupling portions are provided on the strap to enable the carry strap and handle to attach to itself when looping around an object to be carried, to a second carry strap and handle, or to another device. A handle is provided on the carry strap and handle to facilitate comfortable carrying by a user of the object to be carried. The handle is initially coplanar with the carry strap and handle, but folds into a substantially upright position when in use for increased comfort and safety for the user.

19 Claims, 6 Drawing Sheets

U.S. PATENT DOCUMENTS 3,072,986 A 1/1963 Lefnaer
3,098,315 A 7/1963 Bono
3,130,462 A 4/1964 Mitchell
3,143,266 A 8/1964 Imatake
3,147,522 A 9/1964 Schumm
3,147,523 A 9/1964 Logan
3,156,922 A 11/1964 Anderson
3,157,421 A 11/1964 Nierhaus
3,161,929 A 12/1964 Swett
3,167,344 A 1/1965 Applegarth
3,197,830 A 8/1965 Hoadley
3,224,054 A 12/1965 Lige
3,255,501 A 6/1966 Laguerre
3,318,354 A 5/1967 Borisof
3,362,411 A 1/1968 Moller
3,365,753 A 1/1968 Prenner et al.
3,438,095 A 4/1969 Evans
3,493,154 A 2/1970 Engle
3,506,370 A 4/1970 Smith
3,692,218 A 9/1972 Friedman
3,702,203 A 11/1972 Oltmanns
3,709,544 A 1/1973 Oltmanns
3,757,936 A 9/1973 Lindegren
3,766,608 A 10/1973 Fay
3,834,824 A 9/1974 Jahn
3,837,047 A 9/1974 Bunnell
D236,441 S 8/1975 Lloyd
3,913,179 A 10/1975 Rhee
3,944,033 A 3/1976 Simson
3,958,731 A 5/1976 Riedle
3,973,610 A 8/1976 Ballin
3,976,234 A 8/1976 Moudry et al.
3,979,094 A 9/1976 DeWitt
3,997,943 A 12/1976 Jones et al.
4,077,562 A 3/1978 Ballin
4,079,485 A 3/1978 Collier et al.
4,093,288 A 6/1978 Suzuki
4,150,463 A 4/1979 Brown
D252,741 S 8/1979 Taylor
4,174,554 A 11/1979 Flantua
4,235,404 A 11/1980 Kraus
4,284,219 A 8/1981 Standel, Jr.
4,420,857 A 12/1983 Clay
4,466,159 A 8/1984 Burrage
4,477,950 A 10/1984 Cisek et al.
4,501,354 A * 2/1985 Hoffman ..... 206/77.1
4,510,649 A 4/1985 Yudis et al.
4,514,876 A 5/1985 Houlberg
4,535,764 A 8/1985 Ebert
4,558,896 A 12/1985 Farnworth
4,569,108 A 2/1986 Schwab
4,641,360 A 2/1987 Frank
4,696,505 A 9/1987 Shadoan
4,707,833 A 11/1987 Tamaru
4,788,751 A 12/1988 Shely et al.
4,827,566 A 5/1989 Richins
4,896,852 A 1/1990 Akema
4,942,644 A 7/1990 Rowley
4,958,414 A 9/1990 Benoit
4,991,536 A 2/1991 Moshofsky
5,005,891 A 4/1991 Lunsford
5,042,114 A 8/1991 Parrish
5,062,717 A 11/1991 Shockley
5,081,746 A 1/1992 Czwartacki
5,096,248 A 3/1992 Ryan
5,158,368 A 10/1992 Lichtwardt et al.
5,169,199 A 12/1992 De Ruyter et al.
5,293,669 A 3/1994 Sampson
D352,902 S 11/1994 Halverson
5,381,617 A 1/1995 Schwartztol et al.
5,695,234 A 12/1997 Coticchio et al.
5,715,578 A 2/1998 Knudson
5,735,019 A 4/1998 Kerr et al.
5,815,891 A 10/1998 Students et al.
5,836,053 A 11/1998 Davignon et al.
5,956,813 A 9/1999 Cooper
6,062,622 A 5/2000 Susman et al.
6,131,803 A 10/2000 Oliff et al.
6,192,554 B1 2/2001 Dumcum
6,227,399 B1 5/2001 Angus et al.
6,233,786 B1 5/2001 Lin
D447,413 S 9/2001 DuCorday
6,283,312 B1 9/2001 Edgerton
6,311,531 B1 11/2001 Sykes
6,347,434 B1 2/2002 Newman
6,484,366 B1 11/2002 Deschenes et al.
6,502,882 B2 1/2003 Snider et al.
6,513,202 B2 2/2003 Zimmermann

FOREIGN PATENT DOCUMENTS

DE 3014805 10/1981
GB 2352477 1/2001

* cited by examiner

ADJUSTABLE PLASTIC CARRY STRAP HAVING LATERALLY PROJECTING FOLDABLE HANDLES

CROSS-REFERENCE TO RELATED APPLICATIONS

Not Applicable

BACKGROUND OF THE INVENTION

1. Field of the Invention

The invention relates to a strap having male and female end locking portions that can be manually secured so that the strap forms a closed loop, and handle portions that can be manually coupled in-situ to form one or more handles to facilitate manually lifting and carrying an object placed within the loop.

2. Description of the Related Art

It is necessary in many environments, to lift large, sometimes cumbersome objects manually, in the absence of machinery to perform such a task (such as a crane or forklift). Additionally, some objects, while heavy or awkward, may be too small to justify the use of a machine (such as a forklift) or are required to be moved in areas inaccessible to a machine, thus typically being left to be handled manually by a worker.

For example, in a farm environment, while many chores can be at least partially automated, much manual labor is still typically required, such as moving objects from vehicles to a storage facility or vice versa. Some objects that may typically be used in such an environment, (such as a bucket), comprise integral handles of varying types to facilitate manual handling of the object. However, many tasks about an agricultural or industrial environment may require handling bulk materials, in a box, sack, or the form of a roll or cylinder just to name a few. Bulk materials in forms such as this can quickly become unwieldy, which makes the task for a worker more difficult and more dangerous. Stooping down to ground level to pick up a sack or roll of material will almost without doubt place a worker in a position in which he or she is at an increased risk for causing a painful injury in his or her back, or other part of his or her body. Any means for improving the difficulty, comfort and safety levels of such a chore is desirable.

A number of devices for either carrying and/or bundling objects are known. U.S. Pat. No. 5,695,234 to Coticchio et al. describes a carrying device for shopping bags consisting of "loop forming element" (10) and two handles (12, 14) having gripping portions (22 and 22') arranged on the longitudinal ends of the strap portion. The two handles mate with each other via projections 18 and sockets 24 (FIG. 3) or a handle is inserted into a hole to form a noose around an object (FIGS. 10 and 11). The handles described by Coticchio are pre-formed, prior to use.

U.S. Pat. No. 3,493,154 to Engle describes a flexible package carrying strap having a relatively wide width, but manufactured from one piece of material. There is a single handle on the strap of Engle, pre-formed at a longitudinal end of the strap. Adjustability is provided by multiple slots at one end into which the handle end fits.

U.S. Pat. No. 4,558,896 to Farnworth describes a handle for attachment to a load the handle having an open slot (28) for receiving a T-bar (26). The slot (24) is provided to allow the strap portion (12) to curve when in use (FIG. 4). The handle portion of Farnworth is pre-formed, is arranged at a longitudinal end of the strap, and does not fold.

U.S. Pat. No. 4,514,876 to Houlberg describes an injection moulded bag closure having two handle portions (3, 4) attached to bag-carrying bars (1*a*, 1*b*). The handles of Houlberg lock together (FIG. 3) by means of hook and shoulder-shaped portions (6, 7), thereby closing the mouth of the bag (which is already attached to the bag-carrying bars (1*a*, 1*b*)). The widths of the handles of Houlberg are about as wide as the entire opening of the bag.

U.S. Pat. No. 5,735,019 to Kerr et al. describe an assist handle to aid a user in carrying bags (such as Coticchio, above), having sling portion (10) across which bag handles lay. Handle cut-outs (17) are formed in longitudinal ends of the sling (10). A grip (40), is used to make using the device more comfortable, and to hold the two ends of the sling (10) together.

U.S. Pat. No. 5,715,578 to Knudson describes a bundle tie having a rubber band loop (5) and one bar-shaped handle (3) arranged at one end of the loop (5). The handle of Knudson is a rigid bar, and the Knudson device ties by looping the handle (3) through the loop (5).

U.S. Pat. No. 5,005,891 to Lunsford describes a bag handle apparatus with a purpose similar to that of Kerr and Coticchio. Lunsford's device comprises a relatively wide sheet (22) to distribute the weight of a load across a user's hand. Bag handles are placed in a center portion of the sheet and the sheet is wrapped around the bag handles. The entire device acts as a cushion, and does not have any distinct handle.

U.S. Pat. No. 5,096,248 to Ryan describes a bundling handle having a strap portion (11) and grip portion (8), among other features. The handle is used in a manner much like the bundling tie of Knudson (described above), in that the device attached to itself by looping around and through itself (FIG. 4). A user lifts the device by inserting his or her hand into a pre-formed slot (17), which is arranged at a longitudinal end of the bundling handle of Ryan.

U.S. Pat. No. 4,696,505 to Shadoan describes a handle and strap apparatus for hand-carrying articles. Shadoan has a strap portion that can be looped around various sizes and shapes of objects. The strap portion of Shadoan is a separate piece from the rigid handle portion, and connects to the rigid handle (10), which is arranged at an end of the strap portion, by looping through openings (34, 36) therein.

U.S. Pat. No. 6,062,622 to Susman et al. describe a handle clasp for bags consisting of a strap forming a loop around bag handles to be carried, the strap having a wider, in-line handle region (20), where it is held by a user, the handle region being pre-formed, prior to use.

U.S. Pat. No. 1,829,613 to Sato describes a fastener, particularly for fastening stacks of material such as paper. Sato's fastener includes an elongate body with a single male portion and a mating head having a series of transverse slots for receiving the male portion. These multiple slots allow the length of the fastener to adjust to an appropriate size. Sato suggests the use of a malleable metal for his fastener.

U.S. Pat. No. 3,913,179 to Rhee simply describes a tie strap without a handle, having a plurality of slots and tabs, incorporating T-slots 44, 46 and 48.

U.S. Pat. No. 487,145 to Gibbons describes a halter for a horse that includes a strap (f), a distal T-head (k) and linear slots (l) to increase of decrease the length of the strap (f).

U.S. Design Pat. No. 252,741 to Taylor is a U.S. design patent that shows a tie strap without a handle, apparently having a plurality of linear longitudinal holes and two identical angled ends. It appears as though there would be two possible manners in which to affix the ends to a longitudinal hole, if desired. The smaller, most distal protrusion could act as a temporary fixing means that is more easily removed than the triangular portion, which could act as a barb and lock the sections together.

Many people have a need for a simple and inexpensive way to handle bulky objects such as rolls of material, since even a simple roll of plastic can weigh upward of 100 lbs. Thus, a device to facilitate handling of rolls of material, or other objects, that is small and inexpensive enough to be included with a roll of material or other object, is desired.

BRIEF SUMMARY OF THE INVENTION

The invention relates to an adjustable carry strap and handle for facilitating the lifting of an object, such as a roll of material. Additionally, the invention facilitates the bundling of materials. The carry strap and handle includes an elongated and substantially planar strap, having first and second ends, with one end having one or more longitudinally spaced coupling portions. In some embodiments, each coupling portion extends from opposed lateral sides of the second end of the strap, and the first end terminates in a female portion having an aperture adapted to serially receive locking portions of the second end of the strap portion. In these embodiments, each of the coupling portions, when inserted into the aperture, is capable of detachably engaging a portion of the female portion near the aperture.

The carry strap and handle also includes a pair of laterally-protruding handle halves. Depending on the embodiment, each handle half extends from opposed lateral sides of the strap, and is substantially symmetrical to the other about a longitudinal axis of the device. Each handle half has a U-shape with two or more connecting portions that are substantially perpendicular to the longitudinal axis of the strap, and one grip portion that is arranged between the two connecting portions. The grip portion is laterally spaced from the lateral edge of the strap. This positioning forms a space large enough for a hand to fit into and grip the handle. The handle halves initially are coplanar with the strap and the two laterally opposed handle halves are adapted to fold together in-situ to an upright position to form the handle for the strap.

Benefits to using the subject carry strap and handle include increased ease, comfort, stability and safety of an object to be carried, on the part of the user. If an object to be carried does not normally include a handle, one can easily be affixed to the object through use of the subject carry strap and handle. Accordingly, objects such as rolls of knitted netting or film having widths larger than a typical arm span of a user, that as a result are typically awkward to handle, become less awkward. Accordingly, a user will find a decreased need to place his or her body in a position likely to cause harm. This is important, especially considering the heft of objects often handled manually. Users handling of rolls of material, cylinders of compressed gas, sacks, crates, boxes, tubes, pipes, bundles, and individual items (a section of a log, for instance) can all benefit from the subject carry strap and handle.

Additional features and embodiments of the invention are discussed in detail below, with reference to the Figures.

DETAILED DESCRIPTION OF THE INVENTION

Figure 1:
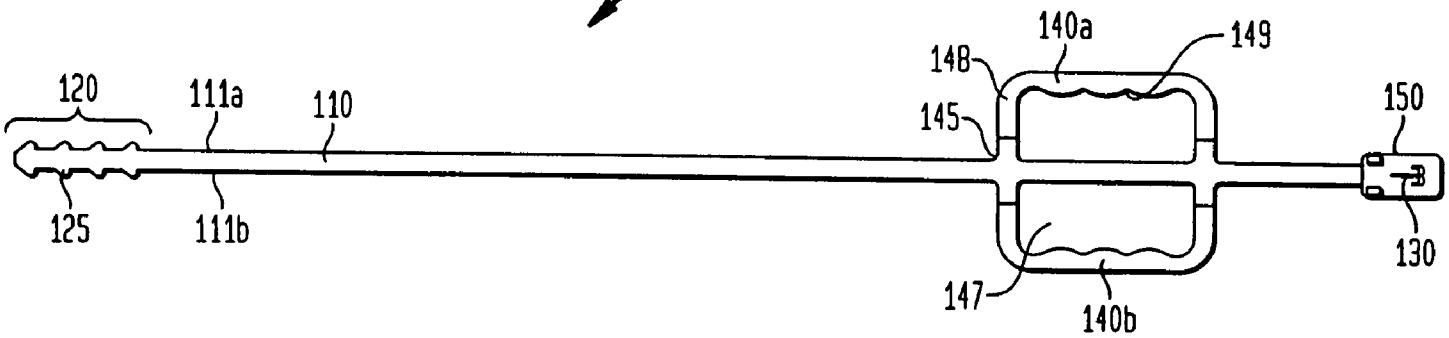
FIG. 1 is a top view of a first embodiment of the present invention.
Figure 2:
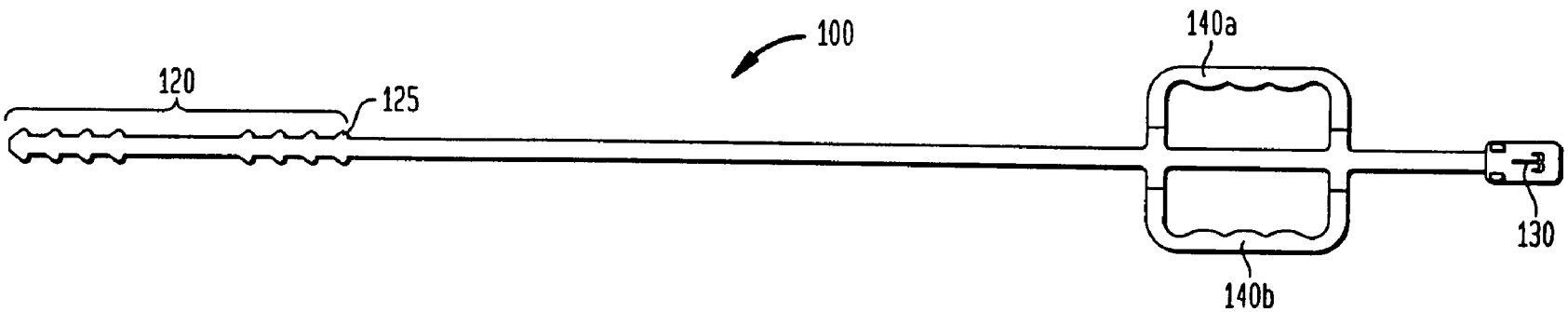
FIG. 2 is a top view of a second embodiment of the present invention.
Figure 3:
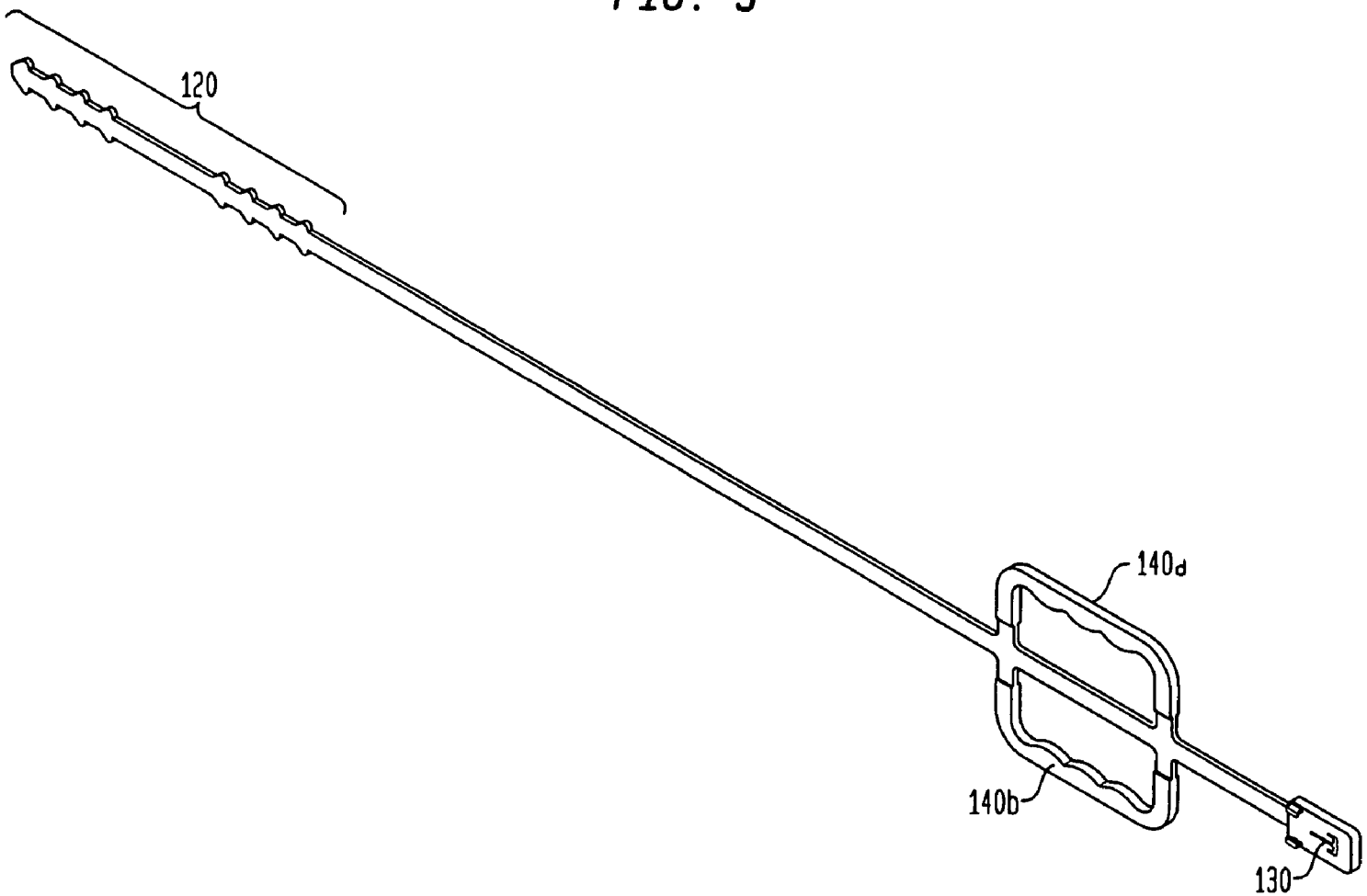
FIG. 3 is a perspective view of the second embodiment of the present invention.

FIG. 1 illustrates a top view of one embodiment of the present invention. Depending on the implementation, the subject carry strap 100 may be used to lift rolls of material, to bundle and lift objects (such as sticks, for example), to lift boxes, or many other types of objects.

The adjustable carry strap and handle 100 includes an elongated and substantially planar strap portion 110. In one embodiment, the second end has one or more longitudinally spaced male coupling regions 120, with each coupling portion extending from opposed lateral sides 111 of the second end of the strap portion 110. In this embodiment, the first end terminates in a female portion 150 having an aperture 130 adapted to serially receive the male coupling region(s) 120 at the second end of the strap. Each of the coupling portions 125, when inserted into the aperture 130, is capable of detachably engaging a portion of the female portion 150.

Figure 4A:
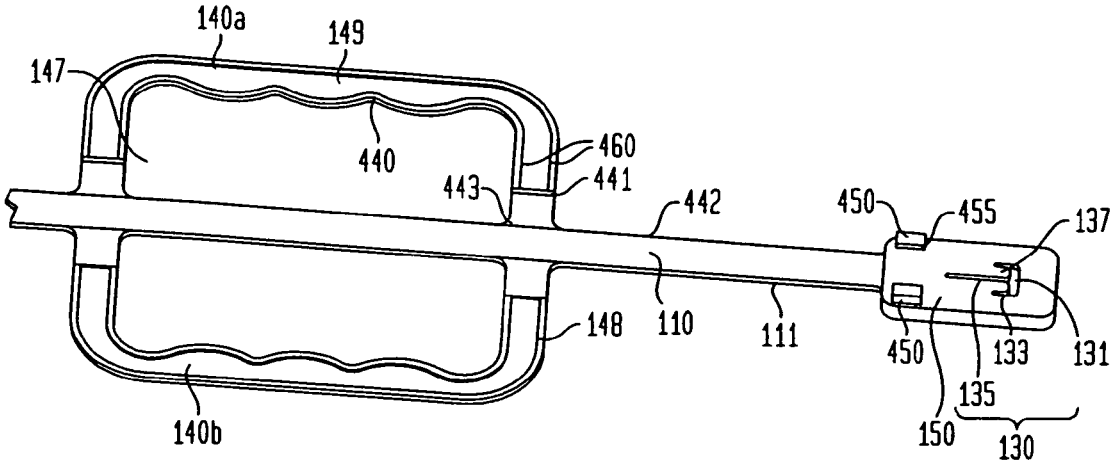
FIG. 4A is an enlarged partial view of an embodiment of the present invention.
Figure 4B:
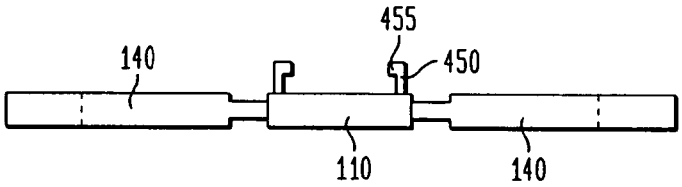
FIG. 4B is an end view of an embodiment of the present invention.

As seen in the embodiments FIGS. 1 and 4, the aperture 130 at the first end of the strap portion 110 for receiving the second end of the strap portion 110 are T-shaped and includes a perpendicular portion 131 arranged substantially perpendicular to the longitudinal axis of the strap portion 110 and a longitudinal portion 135 arranged substantially parallel to the longitudinal axis of the strap portion 110. In this embodiment, the perpendicular portion 131 of the T-shaped aperture 130 is shorter than the longitudinal portion of the T-shaped aperture to facilitate insertion of the coupling region 120 having a width greater than that of the perpendicular portion of the T-shaped aperture 130. In this case, the larger width of the coupling portions 125 further secures the first and second ends of the carry strap and handle 100 to one another. The T-shaped aperture 130 may further comprise tails 133 arranged parallel to the longitudinal portion 135, but at the ends of the perpendicular portion 131. These tails 133 facilitate the insertion of the coupling portions 125, by creating tabs 137 that, while still providing resistance to back-out by partially obscuring the aperture 130, also provide increased ease of insertion, as they are only connected to the strap portion 110 along one edge.

When the mating male coupling region 120 and female coupling portion 150 comprise protuberances such as male coupling portions 125, that have a width wider than the location of the aperture in which the male coupling portions 125 ordinarily reside. Accordingly, when inserted into the aperture 130 of the female portion 150, the relatively wide male coupling portions 125 prevent uncoupling of the male coupling region 120 and the female portion 150. For example, in embodiments having substantially T-shaped apertures 130 and a male coupling region 120 having male coupling portions 125, the steps for attachment are typically as follows. First, the male coupling region 120, is rotated so as to align with the longitudinal portion 135 of the aperture 130, and is inserted into the aperture 130. The male coupling portions 125, while inserted in the longitudinal portion 135, is rotated into alignment with the perpendicular portion 131 of the aperture 130. In this position, and with the strap in a state of tension, a first edge of the male coupling portions 125, abuts against the face of the female coupling portion 150 in regions to the side of the perpendicular portion 131. Since the length of the longitudinal portion 135 is typically greater than that of the perpendicular portion 131, the male coupling region 120 is more easily inserted into this region and is more difficult to remove from the perpendicular portion 131, once fully inserted. Also, since typically, the perpendicular portion 131 is approximately the same width of the strap portion 110, and the width at the male coupling portions 125 is larger than that of the perpendicular portion 131, resistance to pull-out is achieved.

The carry strap and handle 100 may be removed from the object to be carried by any of a variety of means, including cutting a portion of the carry strap and handle 100 or by disengaging the male and female portions 125, 150 in an order that is the reverse of that to attach the male and female portions 125, 150.

The male coupling region 120 at the second end of the strap may, in alternate embodiments, comprise other means for attachment to the first end of the strap and/or female portion 150. In this case the sense of the terms "male" and "female" refers to two regions that are joined together. Such other means for attachment may include a buckle, snaps, hook-and-loop fasteners, staples, adhesive or any other practical means. Alternatively still, attachment of the first and second ends may be achieved with no additional component, for example, by welding, heat-welding, solvent-welding, or crimping the two ends together, depending on the particular embodiment.

In almost any embodiment, the carry strap and handle 100 can be configured to fit about two or more pre-selected circumferences of objects. For example, if a manufacturer sells rolls of material in varying amounts, say 100 yard and 300 yard rolls, then, naturally, the diameters and circumferences will be different. If the subject carry strap and handle 100 is to be used in this situation, then adjustability of the carry strap and handle 100 must be provided. One manner in which this need may be met is to include a series of male coupling portions 125 or protuberances on the second end of the carry strap and handle 100. Each male coupling portion 125 allows coupling of the male and female coupling portions 125, 150 at that point. Since any one diameter object to be lifted necessitates a particular length of strap portion 110, if objects will be selected from two objects each having a different diameter, then only two coupling locations may be necessary. Thus, two or more sets of male coupling portions 125, each longitudinally spaced with respect to the longitudinal axis of the strap portion 110, be used to determine the location at which the first and second ends of the carry strap and handle 110 will attach (and the resultant circumference of the strap). The positions of these tabs will typically correspond to the circumference(s) of objects to be lifted.

Furthermore, male coupling portions 125 may be arranged in groups about two or more pre-selected longitudinal positions. That is, instead of just one pair of male coupling portions 125 near each position, multiple pairs of male coupling portions 125 may be arranged at each location. In this embodiment, additional tabs provide a tolerance for varying roll circumference. So, while a full range of male coupling portions 125 may not be needed, a desired level of adjustability is still achieved. without unnecessary material expense. It is to be understood that principles of the foregoing example embodiments, in which different arrangements of male coupling portions 125 are discussed, can be applied to alternate means for securing the first and second ends of the carry strap and handle 100 to each other (Such as snaps, hook-and-loop fasteners, etc.).

Alternatively, two or more apertures 130 may be included on an enlarged or on multiple female coupling portions 150. As such, adjustability is provided. Yet further, the carry strap and handle 100 may be arranged such that it comprises a plurality of male coupling regions 120 and a plurality of female coupling portions 150. Thus, the particular means by which adjustability is achieved may be selected by the user, and if desired, two or more male and female coupling portions 120, 150 may be utilized at the same time to provide a redundant connection for safety reasons and/or to increase the carrying capacity of the device by distributing the stresses at one connection over a plurality of connections.

The carry strap and handle also includes a pair of laterally-protruding handle halves 140. Each handle half extends from opposed lateral sides 111 of the strap 100, and is substantially symmetrical to the other about a longitudinal axis of the strap 100. The handles preferably lay flat prior to use and when not in use for space savings, and to facilitate stacking of the straps 100 themselves and/or objects held by the straps 100.

Each handle half 140*a,b* may have a U-shape with two or more connecting portions 148 that are substantially perpendicular to the longitudinal axis of the strap, and one grip portion 149 that is arranged between the two connecting portions 148. The grip portion 149 is laterally spaced from the lateral edge 111 of the strap portion 110. This positioning forms a space 147 large enough for a hand to fit into and grip the handle 140.

Alternatively, the handle halves 140*a,b* may comprise T-shaped handle portions connected to the strap by a single, centrally located connecting portion. With this embodiment, a user's fingers sit to each side of the connecting portion, rather than in-between two connecting portions, as with the above embodiment. Alternatively still, the handle halves 140*a,b* may comprise loops to enable a user to grip the carry strap and handle, and the object to be lifted or semi-annular sections consisting of a generally arcuate handle halves attaching at each end to the strap. Such loops and semi-annular sections, U-shape and T-shape handles may be integrally formed with the strap itself or may be made from an additional component that is later attached to the strap portion 110. Also, the handle halves 140*a,b* may be made from a string-like material such as a rope that is attached to the strap portion 110 via eyelets in the strap portion 110. Of course, other shapes for the handles 140 are possible, though not specifically described herein.

Figure 5:
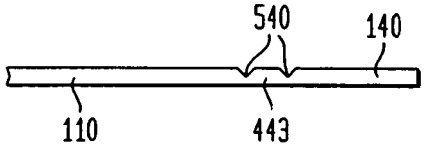
FIG. 5 is a side view of a portion of the handle of one embodiment of the present invention.
Figure 6A:
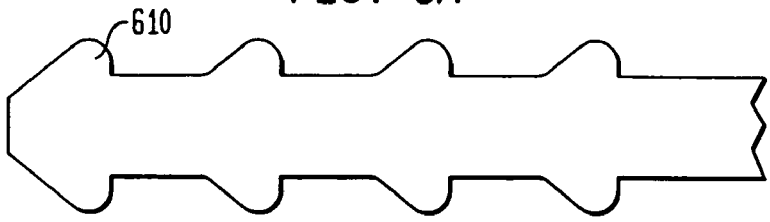
FIGS. 6A–6E illustrate various embodiments for the coupling portions at the second end of the carry strap according to the present invention.
Figure 6B:
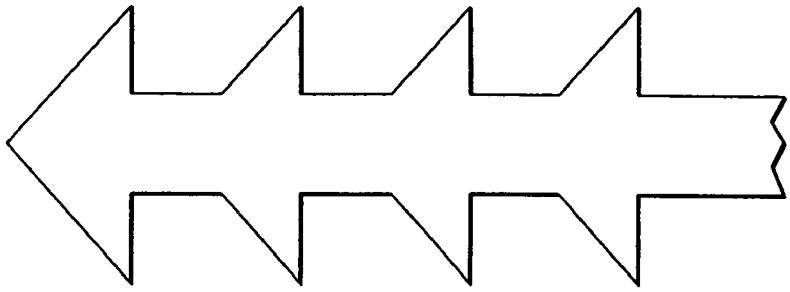
Figure 6C:
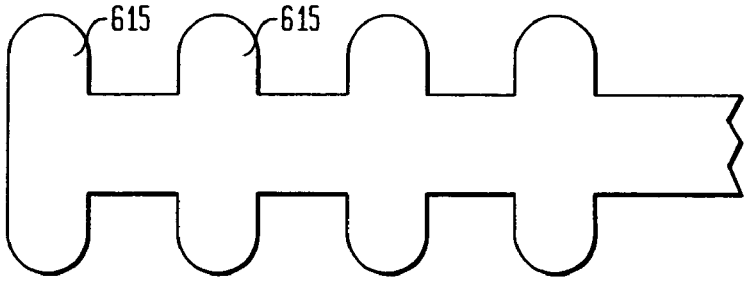
Figure 6D:
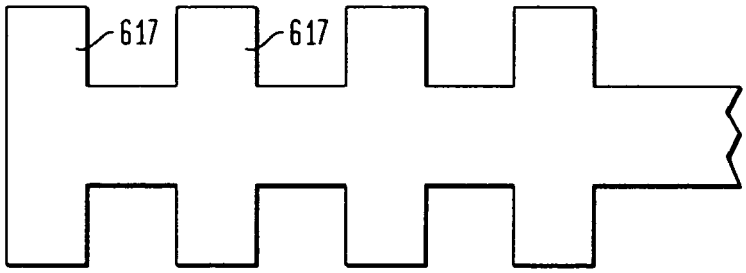
Figure 6E:
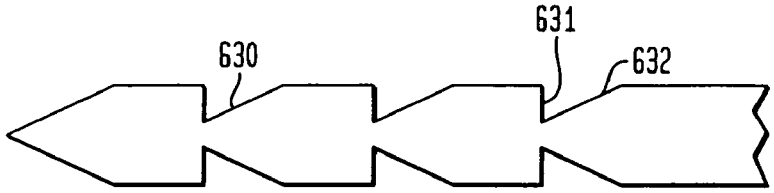

In each embodiment, the handle halves 140*a,b* initially are coplanar with the strap portion 110, and the two laterally opposed handle halves 140*a,b* are adapted to fold together in-situ to an upright position to form the handle for the strap. In the case of U-shaped handle halves, for example, one or more creases 540 FIG. 5) may be formed to facilitate upright folding of the handle halves. Also to facilitate folding, an intermediate connecting portion 443 between the edge 111 of the strap and the handle connecting portion 148, may have a reduced thickness. Further, the intermediate connecting portion 443 may be shaped such that it prevents folding beyond a pre-selected point, for example, the intermediate connecting portion 443 may have a triangular or trapezoidal profile (FIG. 5). Such a configuration results in two "hinges," one on each side of the connecting portion 443, which, when in use, cause adjacent surfaces to fold toward and touch each other, causing interference which prevents the handle from folding beyond a pre-determined point.

The handle halves 140*a,b* may be located near the first end of the strap portion 110, near the second end of the strap portion 110, or at an intermediate location between the first and second ends of the strap portion 110.

Depending on the embodiment, the handle 140 may comprise a flange portion 460 about one or more edges of the handle to provide increased rigidity and comfort for the user. Such a flange portion 460 typically includes a narrow band of an increased thickness along the edge of the handle. The additional material spaced from the middle of the handle helps resist bending stresses in and resulting deformation of the handle 140. The flange portion 460 may be located along an outer contour of the handle 140 and/or along the inner contour 440 of the handle 140.

When using the carry strap and handle 100, a user lifts each handle half 140*a,b* from a normally flat position. If multiple carry strap and handles 100 are used, a user will typically grip one pair of handle halves 140*a,b* in each hand, and lift the object. If the carry strap and handle 100 is embodied such that the spacing between each handle half 140*a,b* is relatively large and/or if only one carry strap is used, the user will typically grip one handle half 140*a,b* in each hand, and lift the object.

In some embodiments, the grip portion 149 of the handle 140 has an undulating contoured inner edge 440 adapted to comfortably fit against a user's fingers, such that when the carry strap and handle 100 is lifted by the user, the undulations prevent excessive sliding of the device about the user's hands. Also, a gripping surface made from a textured or easily gripped material, such as rubber of the like, may be formed on or attached to the surface of the grip portion 149 to reduce undesired movement of the handle about the user's hands.

Also as seen in FIGS. 1–4, the device may further include a pair of tabs 450 at the first end of the carry strap and handle 100. The tabs 450 are adapted to secure an excess portion of the second end of the strap 100 protruding through the aperture 130, to the surface of the strap 100. The tabs 450 extend upward from a first planar surface of the strap 100. The tabs 450 also may have inwardly projecting protrusions 450 located at their upper ends.

FIGS. 6A–6E illustrate various arrangements for the coupling portions at the second end of the carry strap 100. Depending on the specific embodiment, each longitudinally spaced coupling portion at the second end of the strap may include a pair of laterally extending barbs 610 (FIG. 6A) or laterally extending arrow-shaped locking portions (FIG. 6B) on opposite lateral edges of the strap in order to engage with the aperture 130. Alternatively, bosses 615, 617 (FIGS. 6C, 6D) may replace barbs 610. Alternatively still, each coupling portion at the second end of the strap may include a pair of angled notches 630 (FIG. 6E) adapted to lockably engage a portion of the aperture 130. The angled notches 630 have two legs 631,632. A first leg 631 is substantially perpendicular to the longitudinal axis of the strap portion 110. A second leg 632 is oblique to the longitudinal axis of the strap portion 110 such that a distal end of the second leg 632 is located closer to the longitudinal axis of the strap than a first end of the second leg 632. The first leg 631 is capable of detachably engaging the aperture 130 at the first end of the strap portion 110 to prevent loosening of the first and second ends of the strap 130. The second leg 632 allows a one-way ratcheting effect to facilitate tightening of the strap about the object to be lifted.

Figure 7A:
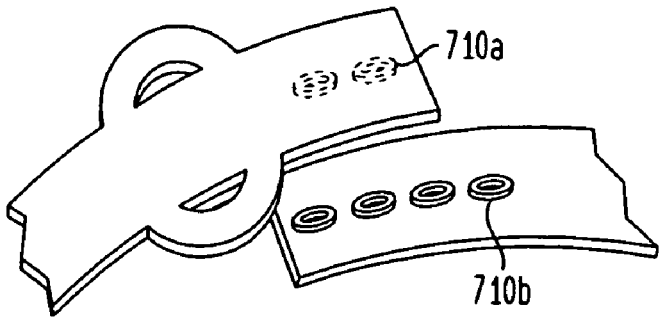
FIGS. 7A–7C illustrate various embodiments for the coupling portions at the second end of the carry strap according to the present invention.
Figure 7B:
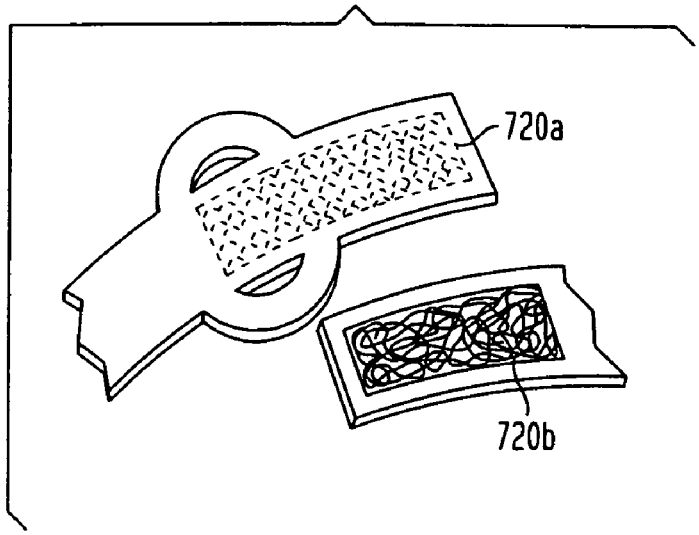
Figure 7C:
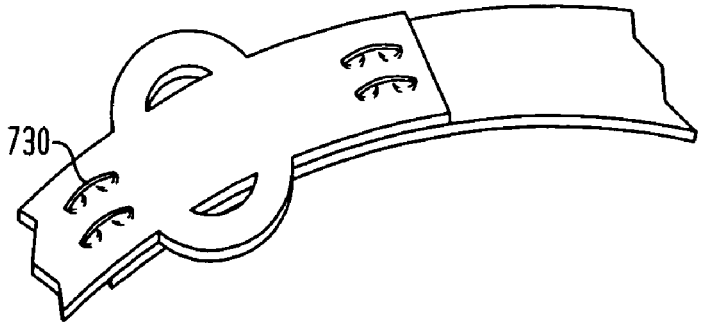

FIGS. 7A–7C illustrate alternative means for attachment of the first and second ends of the carry strap and handle 100, which may include snaps 710*a,b,* hook-and-loop fasteners 720*a,b,* staples 730 or adhesive. Alternatively still, attachment of the first and second ends may be achieved with no additional component, for example, by welding, heat-welding, solvent-welding, or crimping the two sections together, depending on the particular embodiment.

Figure 8A:
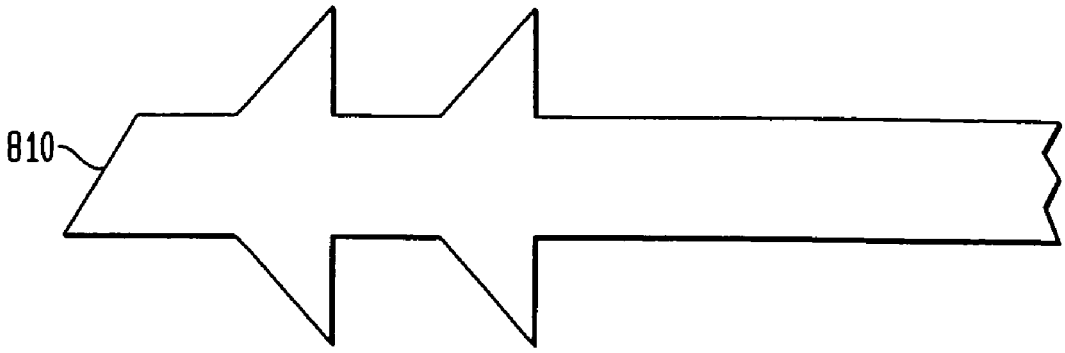
FIGS. 8A–8C illustrate various embodiments of the second ends of the strap portion according to the present invention.
Figure 8B:
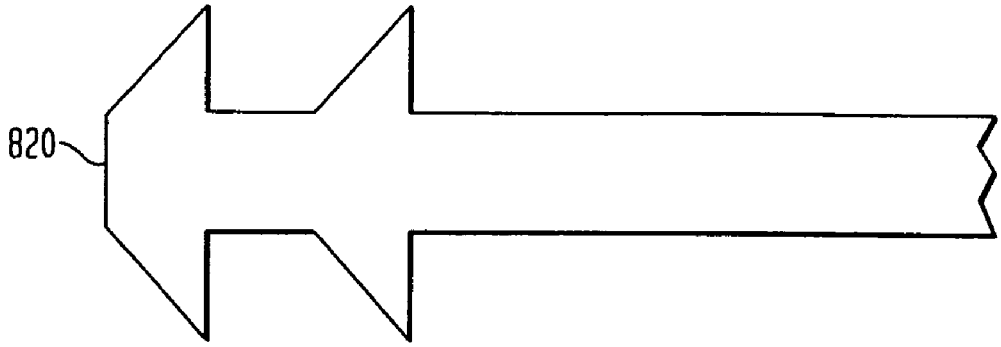
Figure 8C:
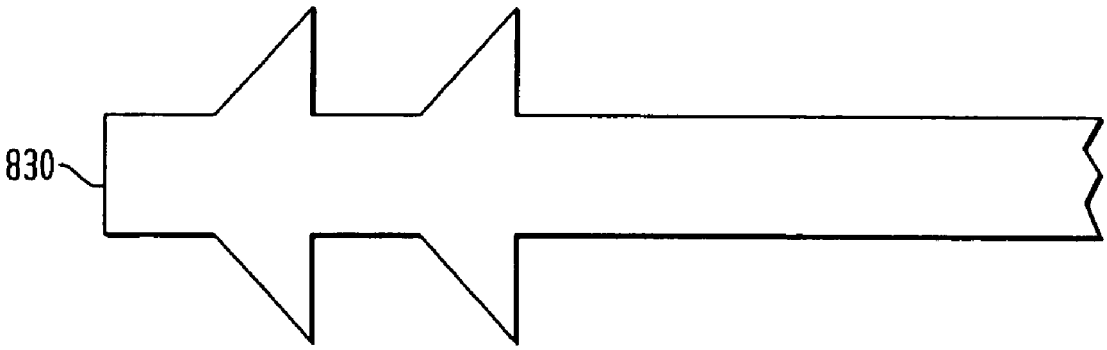

FIGS. 8A–8C illustrate various embodiments of the second end of the strap portion 110. The second end of the strap may terminate (1) in a surface that is oblique 810 to the longitudinal axis of the strap; (2) in a portion symmetrical relative to the longitudinal axis of the strap, having at least one oblique portion 820; or (3) a surface that is substantially perpendicular to the longitudinal axis of the strap 830.

In general, the length of the strap portion 110 may be pre-selected to advantageously approximate a circumference around an object to be lifted. Alternatively, a distance between longitudinally spaced coupling portions 125 may be pre-selected based upon the circumference of the object to be lifted.

The handle halves 140*a,b* may be arranged on the strap portion 110 near the first end of the device 100 and may automatically fold flat when not in use, into the plane of the strap. A gusset 145 may be affixed to and arranged between at least one lateral edge of the strap and at least one connecting portion of the handle, in order to strengthen the junction.

Depending on the embodiment, the subject carry strap 100 may be used alone or in combination with other carry straps 100. The carry straps 100 may be connected end-to-end, or used in parallel on the same object. In the latter situation, two or more carry straps 100 may be spaced apart along the length of an object by a distance approximately that of a user's outstretched arms, to allow the user to comfortably lift the object, with one handle 140 of one carry strap 100 in each hand. Alternatively, the carry strap 100 may be relatively wide, or may have a wide section between the two handle halves 140*a,b* of the carry strap 100. This would provide a comfortable spacing between handle halves 140*a,b*. Similar to the former application, this latter application allows a handle half 140*a,b* to be gripped, one in each hand.

The entire carry strap and handle 100 may be manufactured from a single piece of material. Preferably, the material for fabrication is a plastic. Suitable plastics that may be used include Nylon, Polyolefins such as polyethylene (including low-density polyethylene (LDPE), high-density polyethylene (HDPE), ultra-low-density polyethylene (ULDPE), ultra-high molecular-weight polyethylene (UHMWPE), cross-linked polyethylene (PEX), polyethylene terephthalate (PET)) and polyproylene. Other plastics that are believed suitable include polyester, polyamides, polyvinylchloride (PVC), vinyl, and the like. Particularly preferred are polyethylene and polypropylene. Alternatively, materials for fabrication of the carry strap and handle may include rubbers, metals, paper, cardboard, composite materials and animal products, such as leather. Metals used may include aluminum, copper, steel, and alloys of these, and other metals.

Also alternatively, the carry strap and handle 100 may be manufactured from a plurality of components, each being made from a different material. If the carry strap and handle 100 is manufactured from plastic, it may be cast, molded, shaped, for example by shearing and/or punching from flat stock, or formed by any other suitable means. If the carry strap and handle 100 is manufactured from metal, it also may be cast, stamped, or shaped, for example by shearing and/or punching.

While certain embodiments are described herein, it will be readily apparent that minor changes of structure and operation can be made without departing from the spirit of the invention, as defined by the scope of the appended claims. It is further intended that each element recited in the claims is to be understood as referring to all equivalent elements.

We claim:

1. An adjustable carry strap with foldable handles, comprising:

an elongated, and substantially planar, plastic strap portion having a first end, a second end, and a pre-selected width, the second end having one or more longitudinally spaced male coupling portions, each male coupling portion extending from opposed lateral sides of the second end of the strap portion, adapted to matingly engage a female coupling portion, the first end terminating in the female coupling portion having a width larger than the pre-selected width of the strap portion, the female coupling portion having an aperture adapted to serially receive each male coupling portion of the second end of the strap portion, each of said male coupling portions, when inserted into the aperture of the female coupling portion, being capable of detachably engaging a part of the female coupling portion;

a pair of handle half portions, each handle half extending from opposed lateral sides of the strap portion, and being aligned substantially symmetrically to one another about a longitudinal axis of the strap, each handle half portion having a U-shape with two or more connecting portions substantially perpendicular to the longitudinal axis of the strap portion and one grip portion arranged between the two connecting portions, laterally spaced from the lateral edge of the strap portion, and substantially parallel to the longitudinal axis of the strap portion, the handle half portions initially being coplanar with the strap and the two laterally opposed and symmetrically aligned handle half portions being adapted to fold together in-situ to an upright position to form a handle for the strap portion.

2. The adjustable carry strap with foldable handles of claim 1, wherein the handle half portions comprise a grip region having an undulating contoured inner edge adapted to comfortably fit against a user's fingers, such that when the strap is lifted by the user, the undulations prevent excessive sliding of the strap about the user's hands.

3. The adjustable carry strap with foldable handles of claim 1, wherein each longitudinally spaced coupling portion at the second end of the strap portion comprises a pair of laterally extending barbs on opposite lateral edges of the strap portion.

4. The adjustable carry strap with foldable handles of claim 1, wherein each longitudinally spaced coupling portion at the second end of the strap portion comprises a pair of laterally extending arrow-shaped locking portions on opposite lateral edges of the strap portion.

5. The adjustable carry strap with foldable handles of claim 1, wherein each coupling portion at the second end of the strap portion includes a pair of angled notches adapted to engage a portion of the aperture, the angled notches having two legs, a first leg being substantially perpendicular to the longitudinal axis of the strap portion, a second leg being oblique to the longitudinal axis of the strap portion such that a second end of the second leg is located closer to the longitudinal axis of the strap than a first end of the second leg, the first leg being capable of detachably engaging the aperture at the first end of the strap portion to prevent loosening of the carry strap with foldable handles from about an object to be lifted, the second leg allowing a one-way ratcheting effect to facilitate tightening of the strap about the object to be lifted.

6. The adjustable carry strap with foldable handles of claim 1, wherein the second end of the strap portion terminates in a surface that is oblique to the longitudinal axis of the strap portion

7. The adjustable carry strap with foldable handles of claim 1, wherein the second end of the strap portion terminates in a portion having at least one pair of oblique portions, arranged symmetrically about the longitudinal axis of the strap portion.

8. The adjustable carry strap with foldable handles of claim 1, the second end of the strap portion terminating in a surface that is substantially perpendicular to the longitudinal axis of the strap portion.

9. The adjustable carry strap with foldable handles of claim 1, wherein the aperture in the female portion at the first end of the strap portion, for receiving the second end of the strap, is substantially T-shaped and comprises a perpendicular portion arranged substantially perpendicular to the longitudinal axis of the strap and a longitudinal portion arranged substantially parallel to the longitudinal axis of the strap.

10. The adjustable carry strap with foldable handles of claim 9, wherein the perpendicular portion of the T-shaped aperture is shorter than the longitudinal portion of the T-shaped aperture to facilitate insertion of a male coupling portion having a width greater than that of the perpendicular portion of the T-shaped aperture, the larger width of the male coupling portion helping secure the first and second ends of the adjustable carry strap with foldable handles to one another.

11. The adjustable carry strap with foldable handles of claim 1, further comprising a pair of tabs at the first end of the strap portion, the tabs adapted to secure an excess portion of the second end of the strap portion protruding through the aperture, to the first end of the strap portion, the tabs extending upward from a first planar surface of the strap, the tabs having inwardly projecting protrusions located at their upper ends

12. The adjustable carry strap with foldable handles of claim 1, wherein the length of the strap is pre-selected based upon a circumference of an object to be lifted.

13. The adjustable carry strap with foldable handles of claim 1, wherein a distance between longitudinally spaced male coupling portions is pre-selected based upon a circumference of an object to be lifted.

14. The adjustable carry strap with foldable handles of claim 1, wherein the longitudinally spaced male coupling portions are arranged in sections centered about predetermined longitudinal positions on the strap portion, each predetermined longitudinal position corresponding to a circumference of an object to be lifted.

15. The adjustable carry strap with foldable handles of claim 1, wherein the handles are arranged on the strap portion near the first end of the device.

16. The adjustable carry strap with foldable handles of claim 1, wherein the handles automatically fold flat when not in use, into a plane of the strap portion.

17. The adjustable carry strap with foldable handles of claim 1, further comprising at least one gusset affixed to and arranged between at least one lateral edge of the strap portion and at least one connecting portion of the handle.

18. The adjustable carry strap with foldable handles of claim 1, wherein the adjustable carry strap with foldable handles is affixed to an object, in order to facilitate carrying the object.

19. The adjustable carry strap with foldable handles of claim 18, wherein the object is a roll of knitted plastic netting.

* * * * *